United States Patent [19]

Houdeshell

[11] Patent Number: 4,725,699

[45] Date of Patent: Feb. 16, 1988

[54] LOW ROTARY SPEED DETECTING SWITCH

[76] Inventor: Donald D. Houdeshell, 1647 N. Township Rd. 175, Republic, Ohio 44867

[21] Appl. No.: 928,553

[22] Filed: Nov. 10, 1986

[51] Int. Cl.[4] ..... H01H 29/26; H01H 35/10

[52] U.S. Cl. ..... 200/80 A; 200/226

[58] Field of Search ..... 200/61.47, 80 A, 182, 200/185, 188, 189, 200, 208, 215, 217, 219, 220, 221, 222, 228, 229; 310/11

[56] References Cited

U.S. PATENT DOCUMENTS

| | | | |
|---|---|---|---|
| 1,669,781 | 5/1928 | Rice | 200/80 A |
| 1,711,689 | 5/1929 | Pierce et al. | 200/188 |
| 1,754,494 | 4/1930 | Anderson et al. | 200/188 |
| 1,785,705 | 12/1930 | Taylor | 200/80 A |
| 1,954,019 | 4/1934 | Moore | 200/80 A |
| 2,164,113 | 6/1939 | Kolb | 200/56 R |
| 2,400,609 | 5/1946 | Sherman | 310/46 |
| 2,687,453 | 8/1954 | Saxe | 200/200 |
| 2,744,175 | 5/1956 | Moore | 200/61.47 |
| 2,792,478 | 5/1957 | Ackerman | 200/208 |
| 2,890,304 | 6/1959 | Cole, Jr. | 200/80 A |
| 2,918,545 | 12/1959 | Von Bomhard | 200/61.47 X |
| 3,035,132 | 5/1962 | Sorike et al. | 200/61.47 |
| 3,094,595 | 6/1963 | Hermann | 200/80 A |
| 3,193,746 | 7/1965 | Neyhouse | 200/80 A X |
| 3,226,514 | 12/1965 | Hermann | 200/80 A X |
| 3,743,802 | 7/1973 | Avenick | 200/61.47 |
| 4,312,227 | 1/1982 | Ozols | 73/516 LM |

FOREIGN PATENT DOCUMENTS

| | | | |
|---|---|---|---|
| 47-15299 | 5/1972 | Japan | 200/80 A |
| 5562 | 1/1913 | United Kingdom | 200/80 A |

*Primary Examiner*—James R. Scott

*Attorney, Agent, or Firm*—Fleit, Jacobson, Cohn & Price

[57] ABSTRACT

A rotary housing is provided including relatively electrically insulated and electrically conductive inner and outer peripheral portions with which electrical contacts are electrically engaged. The housing is hollow and encloses a quantity of electrically conductive liquid which, when the housing is rotating below a predetermined low speed of rotation or is stationarily positioned with at least a first predetermined peripheral portion lowermost, establishes electrical contact between the inner and outer peripheral portions and which, when the housing is rotating above the aforementioned predetermined low speed of rotation or is stationary with a second predetermined peripheral portion lowermost, is ineffective to establish electrical contact between the inner and outer peripheral portions.

10 Claims, 7 Drawing Figures

LOW ROTARY SPEED DETECTING SWITCH

BACKGROUND OF THE INVENTION

1. Field of the Invention

This invention relates to a rotary switch for determining and indicating low speed rotation below a predetermined desired speed of rotation and a modified construction whereby a novel multi-rotary position on-and-off switch is provided.

2. Description of Related Art

Various different forms of rotary switches including some of the general structural and operational features of the instant invention are disclosed in U.S. Pat. Nos. 1,711,689, 1,754,494, 2,164,113, 2,400,609, 2,687,453, 2,744,175, 2,792,478, 3,035,132, 3,743,802 and 4,312,227.

However, these previously known forms of rotary switches do not include the novel combination of structural features of the instant invention which gives rise to a rotary switch which is operative in its intended function and which is substantially trouble free in operation.

SUMMARY OF THE INVENTION

The low rotary speed determining switch of the instant invention has been specifically designed to actuate any desired form of warning signal or control system responsive to speed of a rotating component dropping below a predetermined minimum desired speed of rotation. The switch is disclosed in two basic forms for determining excess low speed rotation and two additional modified forms wherein the general structure of the switch has been modified to develop two different forms of rotary on-and-off switches.

The main object of this invention is to provide a low speed rotation switch which will be operative to actuate a signal or other control responsive to the speed of rotation of an associated rotatable component dropping below a predetermined speed of rotation.

Another object of this invention is to provide a first form of rotatable switch in accordance with the preceding object capable of handling low voltage.

Yet another object of this invention is to provide a rotary switch which will be capable of handling high voltage.

Still another object of this invention is to provide a rotary switch in accordance with the preceding objects which is fully sealed relative to the ambient environment.

A final object of this invention to be specifically enumerated herein is to provide a rotary switch in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENTS

Figure 1:
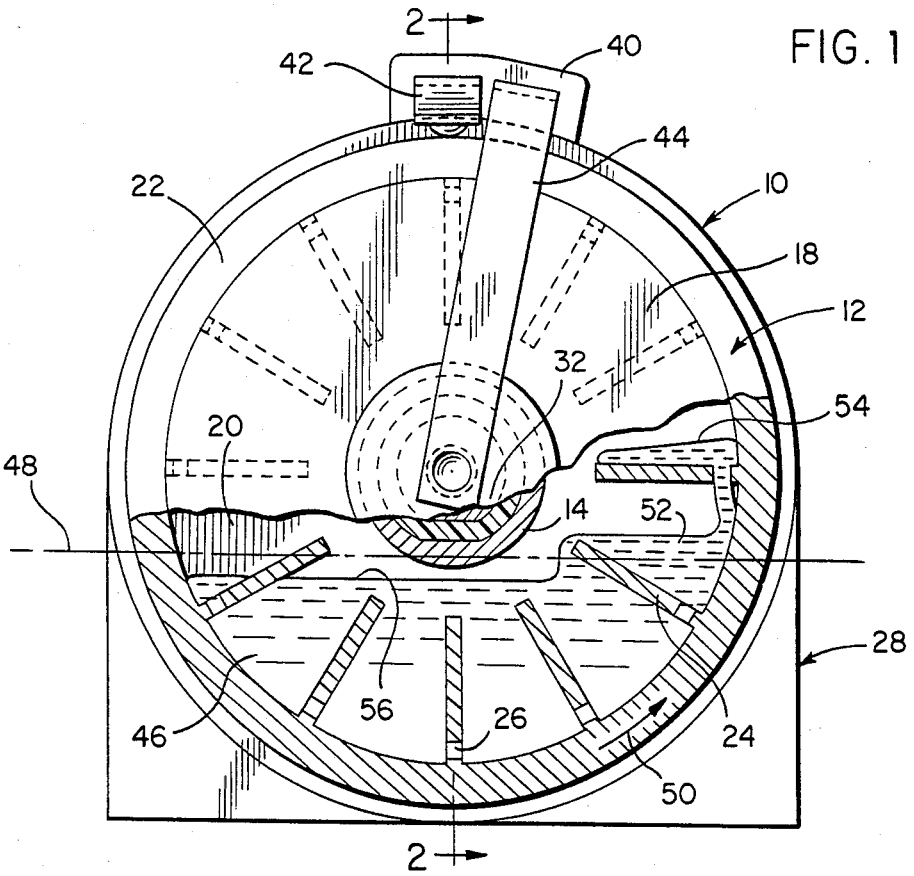
FIG. 1 is a axial end view of a first form of rotary switch constructed in accordance with the present invention and with lower near-side portions of the switch housing being broken away and illustrated in vertical sections.
Figure 2:
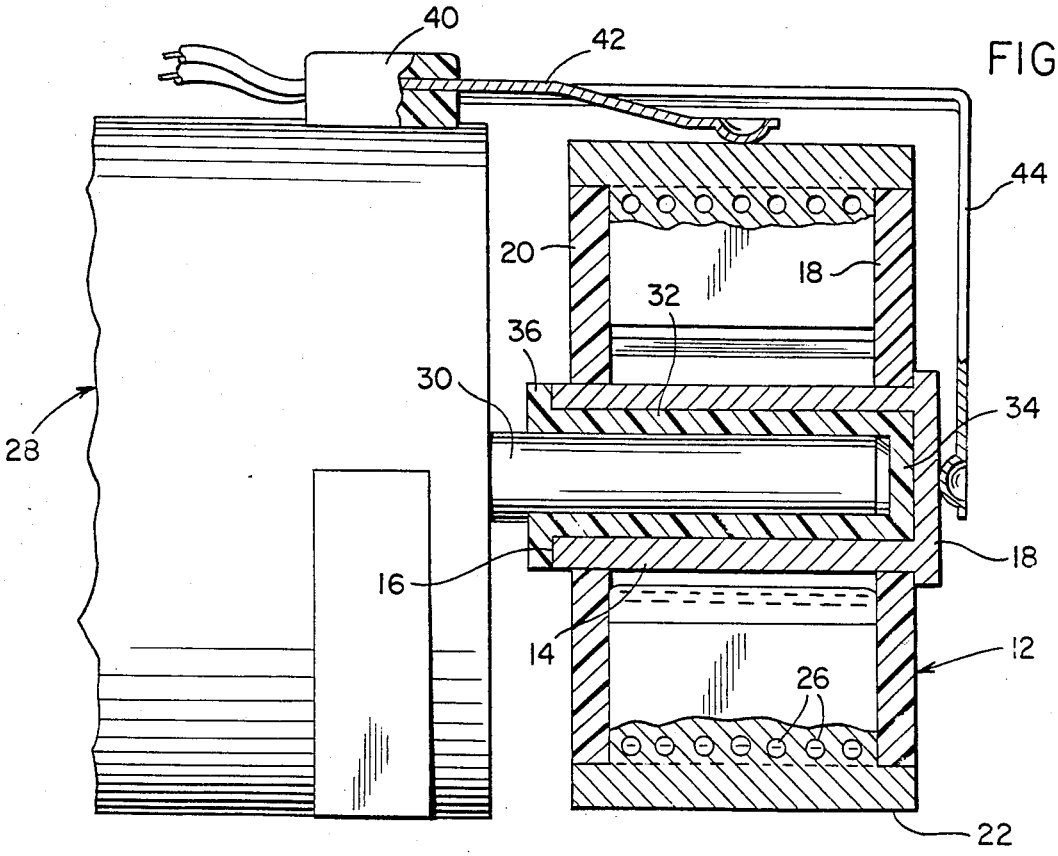
FIG. 2 is a fragmentary vertical sectional view taken substantially upon the plane indicated by the section line 2—2 of FIG. 1.

Referring now more specifically to the drawings, the numeral 10, in FIG. 1 and 2, generally designates a first form of rotary switch constructed in accordance with the present invention. The switch 10 includes a closed rotary hollow housing referred to in general by the reference numeral 12. The housing 12 includes an inner sleeve portion 14 open at one end as at 16 and including an end wall 18 closing the other end. The sleeve portion 14 is constructed of electrically conductive material and the housing 12 includes a pair of annular dielectric axial end walls 18 and 20 disposed on the sleeve portion 14 spaced inward from the opposite ends thereof and with the end walls 18 and 20 fixed in position on and sealed relative to the sleeve portion 14 in any convenient manner. The outer periphery of the housing 12 is closed by an outer circumferential sleeve portion for wall 22 in whose opposite ends the outer peripheral portions of the end walls 18 and 20 are sealingly secured.

The sleeve portion 22 includes integral radially inwardly projecting vanes 24 which terminate radially inwardly a spaced distance outwardly of the sleeve portion 14 and the radial outermost base ends of the vanes 14 supported from the sleeve portion 22 include apertures 26 formed therethrough for a purpose to be hereinafter more fully set forth.

In FIGS. 1 and 2, the reference numeral 28 generally designates a component from which a driven rotary shaft 30 is journalled. The component 28 could comprise a bearing structure, an electric motor housing or any other component relative to which a shaft may be rotatably supported. The shaft 30 is constructed of conductive material and has a dielectric sleeve 32 mounted thereon. The sleeve includes an outer end including an integral dielectric end wall 34 against whose outer surface the inner surface of the wall 18 is abutted and the inner end of the sleeve 32 includes an integral dielectric radially outwardly projecting abutment flange 36 against which the open inner end of the sleeve portion 14 is abutted.

A switch 40 is supported from the component 28 and includes a first spring contact 42 slidingly engaged with the outer periphery of the conductive sleeve portion 22 and a second spring contact 44 with which the central portion of the outer surface of the electrically conducted end wall 18 is rotatably engaged.

The sleeve 32 is mounted on the shaft 30 for rotation therewith and the sleeve portion 14 is mounted on the sleeve 32 for rotation therewith. The interior of the housing 12 has a quantity of electrically conductive liquid 46 contained therein. Mercury may be used for the liquid 46, or other electrically conductive liquids may be used. Further, it is to be noted that the selection of a particular electrically conductive liquid for use as the liquid 46 may be determined according to the viscosity of the desired liquid.

With attention now invited more specifically to FIG. 1 of the drawings, it will be noted that the level of the liquid 46 within the housing 12, when the latter is at rest, is the level 48 shown in FIG. 1 with the lower peripheral portion of the sleeve portion 14 projecting below the level 48. Thus, an electrical connection is established between the sleeve portion 14 and the sleeve portion 22 with which the contacts 44 and 42 are electrically connected. Therefore, when the housing 12 is at rest an electrical circuit is completed between the contacts 42 and 44.

However, when the housing 12 is rotating in the direction of the arrow 50 shown in FIG. 1 at a speed greater than a predetermined minimum speed of rotation, the vanes 24 elevate a portion of the liquid 46 as at 52 and 54 before the liquid 46 can flow through the corresponding apertures 26 back into the lower portion of the housing 12 and the effective level of the liquid 46 within the housing 12 is lowered to the level 56 as shown in FIG. 1 spaced below the lower peripheral portion of the sleeve portion 14. Thus, when the housing 12 is being rotated above a minimum speed of rotation in the direction of the arrow 50 (or in the opposite direction) electrical contact between the contacts 42 and 44 ceases to exist.

Figure 3:
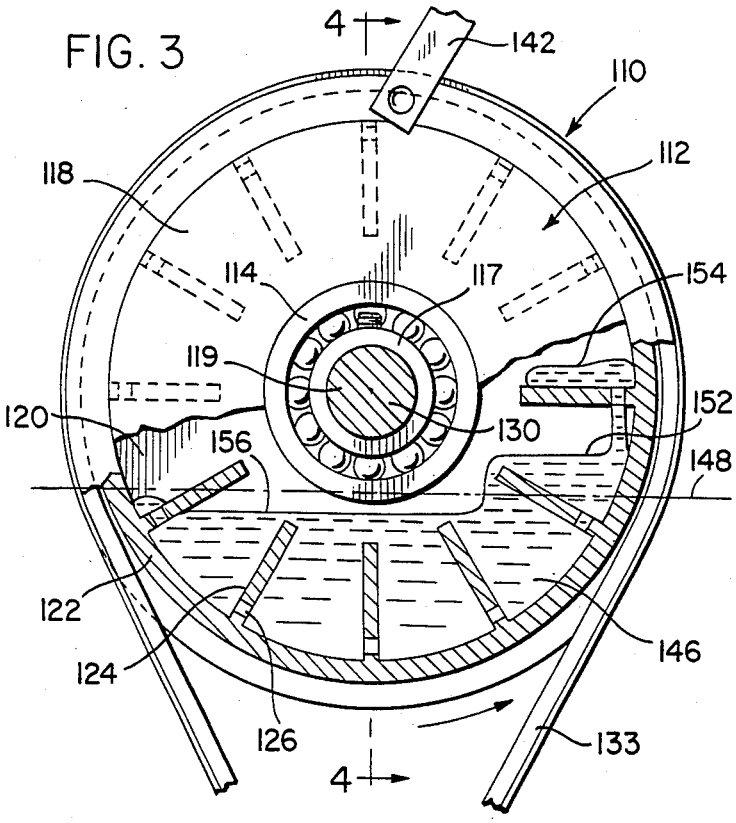
FIG. 3 is an axial end elevational view similar to FIG. 1 but illustrating a second form of rotary switch adapted to handle low voltage as opposed to the switch of FIGS. 1 and 2 which handle high voltage.
Figure 4:
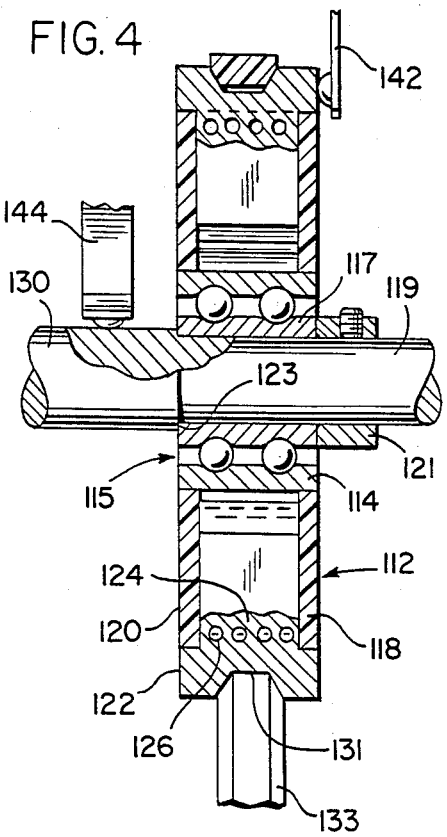
FIG. 4 is a vertical sectional view taken substantially upon the plane indicated by the section line 4—4 of FIG. 3.

With attention now invited more specifically to FIGS. 3 and 4 of the drawings, a second form of rotary switch is referred to in general by the reference numeral 110. The rotary switch 110 includes a housing 112 corresponding to the housing 12 but wherein an inner sleeve portion 114 corresponding to the sleeve portion 14 actually comprises the outer race of a bearing assembly referred to in general by the reference numeral 115. The bearing assembly 115 includes an inner race 117 seated upon a diametrically reduced portion 119 of a shaft 130 corresponding to the shaft 30 and a removable lock collar 121 secures the inner race 117 on the shaft 130 against the shoulder 123 defined by the diametrically reduced portion 119. The entire bearing assembly 115 is constructed of electrically conductive material as is the shaft 130 and the end walls 118 and 120 of the housing 112 corresponding to the end walls 18 and 20 are constructed of dielectric material. In addition, the outer sleeve portion 112 corresponding to the sleeve portion 22 is constructed of electrically conductive material and includes radially inwardly projecting circumferentially spaced vanes 124 corresponding to the vanes 24 and including apertures 126 corresponding to the apertures 26. The shaft 130 is stationary, as is the inner race 117, and the outer peripheral surface of the sleeve portion 122 includes a circumferential groove 131 in which an endless flexible drive belt 133 is seated. The drive belt 133 also is entrained about a driven rotatable member (not shown) for imparting rotation to the housing 112. The housing 112 has an electrically conductive liquid 146 disposed therein corresponding to the liquid 46 and disposed at levels 152 and 156 corresponding to levels 52 and 56. Accordingly, a first contact 144 corresponding to the contact 44 may be engaged with the stationary shaft 130 and second contact 142 corresponding to the contact 42 may be engaged with one axial end face of the outer sleeve portion 122. Otherwise, the switch 110 is operationally the same as the switch 10.

Figure 5:
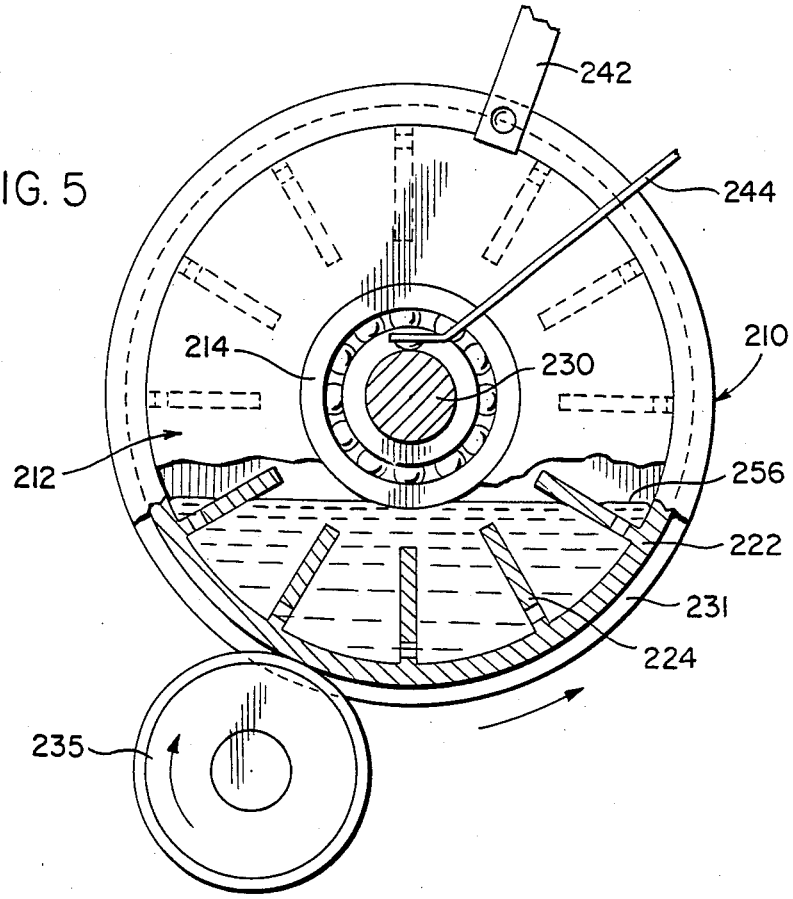
FIG. 5 is an axial end elevational view of a slightly modified form of low voltage switch similar to that illustrated in FIGS. 3 and 4.

With the attention now invited to FIG. 5 of the drawings, there may be seen a rotary switch 210 which is very similar in construction and operation to the switch 110. The switch 210 differs from the switch 110 only in that the groove 231 formed in the outer periphery of the outer sleeve portion 222 has a drive wheel 235 engaged therein as opposed to an endless flexible drive belt such as the belt 133. Therefore, it may be seen that the switches 110 and 210 are identical, except for the manner in which the outer sleeve portions thereof are driven, the sleeve portion 122 being driven by an endless flexible belt 133 and the sleeve portion 222 being driven by a drive wheel 235. Further, those components shown in FIG. 5 corresponding to the similar components shown in FIG. 3 are identified by reference numerals in the 200 series corresponding to the reference numerals used in FIG. 3.

Figure 6:
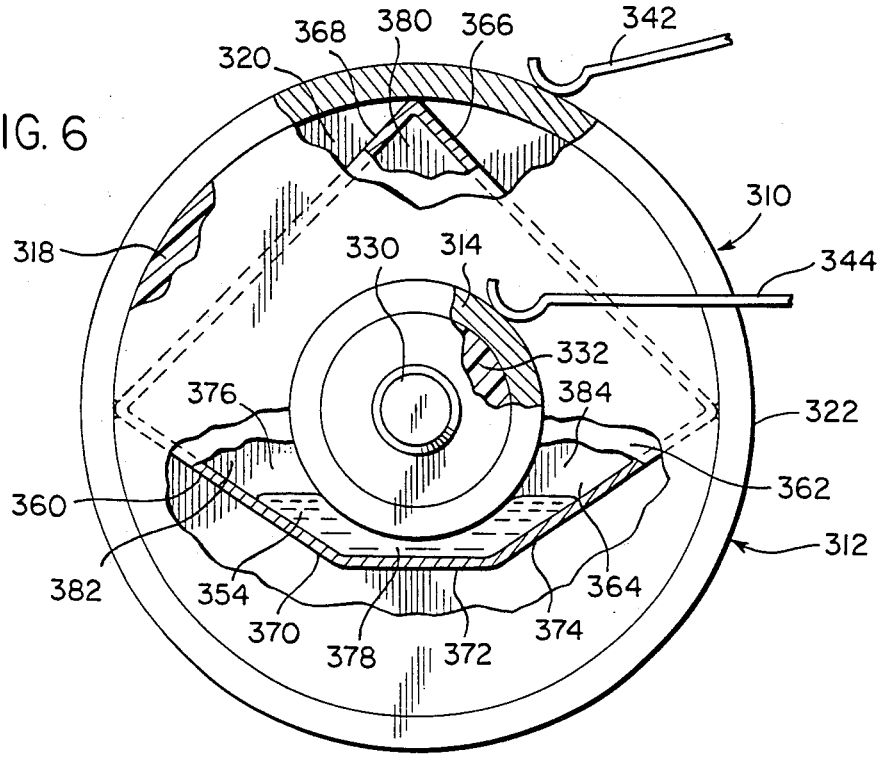
FIG. 6 is an axial end elevational view of a rotary on-and-off switch constructed in accordance with the present invention and with various near side portions thereof being broken away and illustrated in vertical section, the switch comprising a 180° on-off switch.

Referring now more specifically to FIG. 6, there will be seen a rotary switch referred to in general by the reference numeral 310. The rotary switch 310 is simlar to the rotary switch 10 in that the switch 310 includes an inner dielectric sleeve 332 mounted on a shaft 330 and a housing 312 including an inner conductive sleeve portion 314 mounted upon the inner dielectric sleeve 332. The housing 312 includes a pair of dielectric end walls 318 and 320 corresponding to the end walls 18 and 20 and a first contact 342 corresponding to the contact 42 is disposed in electrical contact with the outer peripheral surface of the sleeve portion 322 of the housing 312 corresponding to the sleeve portion 22. In addition, a second contact 344 electrically connects an outwardly projecting axial end of the inner conductive sleeve portion 314 on its outer peripheral surface.

The sleeve portion 322, however, is not provided with vanes corresponding to the vanes 24. Rather, a closed irregular-shaped inner housing 360 is provided. The housing 360 includes opposite end walls 362 and 364 having central registered openings therein relative to which the outer peripheral surface of the sleeve portion 314 are sealingly secured. The housing 360 includes five peripheral walls 366, 368, 370, 372 and 374 interposed between the end walls 362 and 364 and completely enclosing the outer periphery of the housing 360. The walls 366–374 are sealingly secured to each other and the end walls 362 and 364 whereby a closed compartment is defined within the housing 360. The closed compartment 376 defined within the housing 360 includes four compartment portions 378, 380, 382 and 384 spaced about the inner conductive sleeve portion 314 and in free communication with each other. The compartment portion 378 extends only a short distance outward from the sleeve portion 314 and the compartment portions 380, 382 and 384 each extend further radially outward from the inner conductive sleeve portion 314. When either of the compartment portions 380, 382 or 384 is disposed lowermost, the level of conductive liquid 354 within the housing 360 is not sufficiently high enough to contact the lower portion of the outer periphery of the inner conductive sleeve portion 314.

Accordingly, in these instances, electrical contact between the contacts 342 and 344 is interrupted.

However, when the compartment portion 378 is disposed lowermost, the level of conductive liquid 354 is sufficiently high in the compartment 376 to contact the lower periphery of the inner conductive sleeve portion 314. Therefore, inasmuch as the housing 360 is in electrical contact with the inner periphery of the sleeve portion 322 at the outermost limits of the compartments or cavity portions 380, 382 and 384, when the compartment portion 378 is disposed lowermost, electrical contact is established between contacts 342 and 344.

Figure 7:
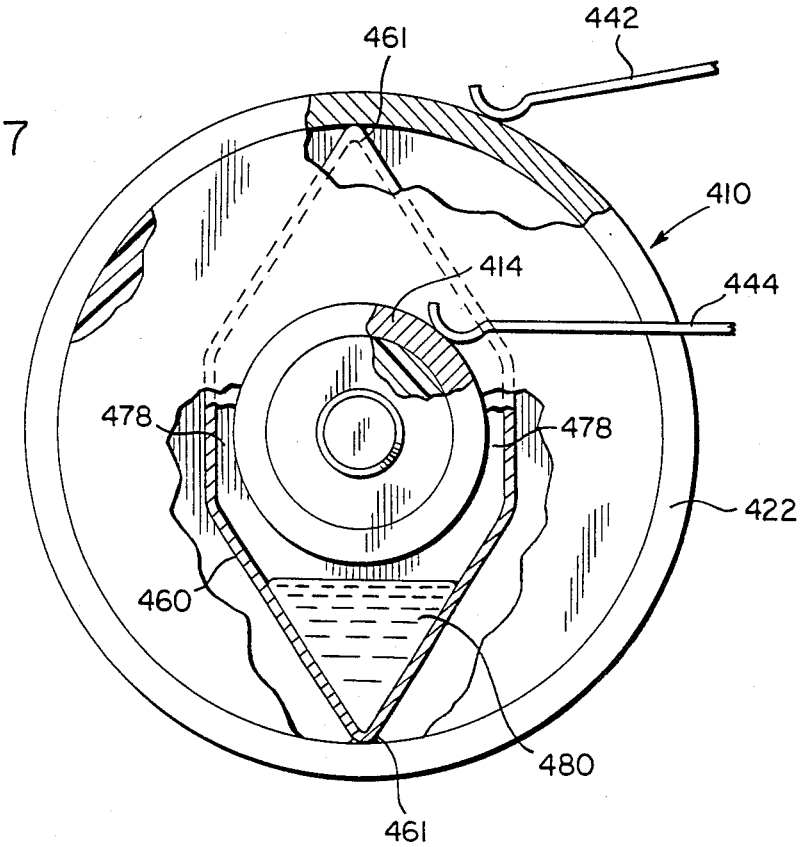
FIG. 7 is a modified form of one-off switch similar to that illustrated in FIG. 6 but comprising a 90° on-off switch.

With attention now invited more specifically to FIG. 7 of the drawings, an additional form of rotary switch referred to in general by the reference numeral 410 is illustrated. The rotary switch 410 is substantially identical to the rotary switch 310, except that the housing 460 thereof includes only two apex portions 461 in electrical contact with the inner periphery of the outer sleeve portion 422 and the interior of the housing includes two diametrically opposite compartment portions 478 which extend only a minor radial distance outward from the inner sleeve portion 414. Accordingly, in two diametrically opposite 180° positions of the switch 410, electrical contact between the contacts 442 and 444 corresponding to the contacts 342 and 344 is interrupted. The FIG. 7 representation of the switch 410 illustrates one of the two "off" positions of the switch 410. If, however, the switch 410 is rotated 90° in either direction from the position of the switch 410 illustrated in FIG. 7, one of the compartment portions 478 will be disposed lowermost and the level of the conductive liquid 480 therein will be sufficient to bridge between the electrically conductive peripheral walls of the housing 460 and the lower peripheral portion of the inner sleeve portion 414 of the switch 410.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rotary switch including a closed rotary hollow housing angularly displaceable about a horizontal center axis, said housing defining an annular cavity therein at least generally centered relative to and extending about said axis, first outer peripheral wall means defining the outer periphery of said cavity, second inner peripheral wall means defining the inner periphery of said cavity extending about said axis in radial spaced relation thereto and opposite end wall means extending between said inner and outer peripheral wall means closing the opposite ends of said cavity, said inner and outer peripheral wall means being constructed of electrically conductive material, said end wall means being constructed of dielectric material whereby said inner and outer wall means are electrically insulated relative to each other, a quantity of electrically conductive liquid disposed in said cavity engaging said inner and outer wall peripheral means and to a level below which said inner peripheral wall means projects in at least one angular position of said housing about said axis when said housing is stationary, and first and second stationary electrical contact means disposed exteriorly of said housing and engaging said outer and inner wall means, respectively, in a manner enabling rotation of said housing about said axis and relative to said contact means while maintaining constant electrical connection between said contact means and outer and inner wall means, at least the outer peripheral portions of said cavity including liquid flow restricting means restricting the flow of liquid about the outer peripheral portion of said cavity, whereby rotation of said housing about said axis above a predetermined speed will cause a sufficient quantity of said liquid to be held by centrifugal force against said outer peripheral wall means to lower the standing level of liquid in said cavity to a level below the lowest portion of said inner peripheral wall means and thereby break electrical connection between said inner and outer peripheral wall means and said second and first electrical contact means.

2. The rotary switch of claim 1 wherein said housing is journalled on an electrically conductive shaft portion by bearing means establishing an electrical connection between said shaft portion and said inner wall means, said second contact means being disposed in electrical contact with said shaft portion.

3. The rotary switch of claim 1 wherein said housing is mounted on a driven shaft for rotation therewith.

4. The rotary shaft of claim 1 wherein said said liquid flow restricting means includes peripherally spaced abutments displaced between said end wall means and spaced radially outwardly of said inner wall means, the portions of said outer periphery of said cavity disposed between pairs of peripherally adjacent abutments defining pockets in which to receive said liquid.

5. The rotary switch of claim 4 wherein said housing is journalled on an electrically conductive shaft portion by bearing means establishing electrical connection between said shaft portion and inner wall means, said second contact means being disposed in electrical contact with said shaft portion.

6. The rotary switch of claim 5 wherein said outer wall means includes an outer peripheral groove formed therein, a drive belt trained about said housing and seated in a portion of said groove.

7. The rotary switch of claim 5 wherein said outer wall means includes an outer peripheral surface portion concentric with said axis, and a driven rotary wheel drivingly engaged with said outer peripheral surface portion.

8. The rotary switch of claim 1 including dielectric means mounting said housing inner peripheral wall means on a driven rotary shaft concentric with said axis, said liquid flow restricting means includes radially inwardly projecting vanes extending between said end wall means, the radial outermost base ends of said vanes including liquid flow passages formed therethrough.

9. the rotary switch of claim 1 wherein said liquid flow restricting means includes a closed conductive housing with wall portions defining two pair of diametrically opposite compartment portions within said cavity, each pair of compartment portions being spaced different distances from said axis whereas a given pair of diametrically opposed compartment portions are equally spaced from said axis.

10. The rotary switch of claim 1 wherein said liquid flow restricting means includes a closed conductive housing with wal portions defining a plurality of compartment portions within said cavity, one compartment portion being spaced closer to said axis than the remaining compartment portions.

* * * * *